US007374138B2

(12) United States Patent
Marshall

(10) Patent No.: US 7,374,138 B2
(45) Date of Patent: May 20, 2008

(54) CEILING FAN DISPLAY

(76) Inventor: John C. Marshall, 6249 Thibodeaux Rd., Greenwell Springs, LA (US) 70739

( * ) Notice: Subject to any disclaimer, the term of this patent is extended or adjusted under 35 U.S.C. 154(b) by 0 days.

(21) Appl. No.: 10/739,080

(22) Filed: Dec. 19, 2003

(65) Prior Publication Data

US 2005/0133675 A1 Jun. 23, 2005

(51) Int. Cl.
*F16M 13/00* (2006.01)

(52) U.S. Cl. ..... 248/159; 248/155.4; 248/121; 40/607.04; 108/49; 416/246

(58) Field of Classification Search ..... 248/155.4, 248/159, 121, 127, 158, 126, 161, 125.8, 248/354.1; 40/607.04, 607.09, 607.1, 611.01, 40/607.13; 108/49; 417/246
See application file for complete search history.

(56) References Cited

U.S. PATENT DOCUMENTS 1,511,597 A * 10/1924 Fergusson ..... 40/607.1
1,744,635 A * 1/1930 Holder ..... 248/158
2,352,496 A * 6/1944 Rose ..... 211/173
2,515,343 A * 7/1950 Gravely ..... 56/17.6
2,671,373 A * 3/1954 Sanzone ..... 84/376 A
2,911,982 A * 11/1959 Guden ..... 131/175
2,964,202 A * 12/1960 Gingher et al. ..... 108/30
3,519,234 A * 7/1970 Matson ..... 248/156
3,889,910 A * 6/1975 Walters ..... 248/122.1
4,524,533 A * 6/1985 Still, Jr. ..... 40/607.06
4,549,366 A * 10/1985 Gerding et al. ..... 38/102.2
4,625,937 A * 12/1986 Haase ..... 248/545
D297,973 S 10/1988 Everett, Jr.
D299,858 S 2/1989 Davis
5,114,016 A 5/1992 Todd
5,273,402 A * 12/1993 Maury ..... 416/246
5,320,049 A * 6/1994 Rowland ..... 108/150
D357,608 S 4/1995 Todd, Jr.
5,475,386 A * 12/1995 Luoma ..... 340/908
5,509,543 A 4/1996 Weaver et al.
D372,967 S 8/1996 Mitchell
5,558,501 A 9/1996 Wang et al.
6,027,309 A 2/2000 Rawls et al.
6,158,701 A * 12/2000 Deshler ..... 248/127
6,431,822 B1 * 8/2002 Schwing ..... 415/5
6,457,683 B1 * 10/2002 Armstrong, Sr. ..... 248/122.1
6,560,794 B2 * 5/2003 Allen et al. ..... 5/81.1 R

* cited by examiner

*Primary Examiner*—Kimberly T. Wood
(74) *Attorney, Agent, or Firm*—Berenato, White & Stavish

(57) ABSTRACT

The ceiling fan display comprises a stand having a vertical support with a horizontal support base extending from the bottom of the vertical support, and a horizontal support arm extending from the top of the vertical support. The ceiling fan is disposed at the distal end of the horizontal support arm. The horizontal support base is comprised of structural members that extend outward from the vertical support to form a "T" shaped outline. Boxes of the displayed ceiling fans may be stacked on the horizontal support base as a part of the sales display.

13 Claims, 3 Drawing Sheets

CEILING FAN DISPLAY STAND

CEILING FAN DISPLAY STAND

CEILING FAN DISPLAY STAND

CEILING FAN DISPLAY STAND

CEILING FAN DISPLAY

BACKGROUND OF THE INVENTION

1. Field of the Invention

The present invention is applicable generally to modular product displays and display stands. Specifically, the invention relates to a display for a ceiling fan, with the display preferably having a base to support fans offered for sale and signage brackets advertising the fans.

2. Description of the Prior Art

Ceiling fan displays may exhibit multiple types and models of fans in a relatively limited space. The displays are primarily comprised of a relatively large mechanical framework suspended from the ceiling or extending upward from the floor. The multi-product displays commonly occupy an aisle or section of a retail store and allow customers to view an entire product line from a single vantage point. Boxes containing the actual products are generally stored remotely, and the assistance of a sales person may be required to locate a specific model. Decorative lights and other types of displays are commonly interspersed with the exhibited ceiling fans. The displays may include a relatively complex panel of electrical controls designed to individually turn the display fans on and off.

Multi-product ceiling fan displays are not readily mobile and not easily adaptable to the special needs of a retailer. These displays are large, expensive, cumbersome, and fixed in a single location. These characteristics prevent the display from being moved to the front of a retail store, for example, where a product may be more effectively promoted. Additionally, ceiling fan manufacturers who wish to have their product displayed must compete with other fan and light manufacturers for the relatively limited space on the large multi-product displays. Further, because of the complexity of the wiring required for the multi-product control panels, all of the displayed fans may not function as intended.

The prior art also includes ceiling fan displays for individual fans. These displays may be assembled from lumber available at a retailer's store. While these displays are more mobile than the multi-product displays, they must be custom assembled for each individual display. Moreover, they cannot be quickly and easily disassembled and shipped to a new location, and subsequently re-assembled.

A need exists for a more flexible and efficient means of displaying ceiling fans. The present invention has the advantage of individually displaying a ceiling fan in its normal, hung position, while simultaneously allowing substantially more flexibility in the sales presentation of the merchandise. The lightweight tubular design of the present invention allows the display to be shipped "knocked down" to a retailer, and assembled quickly and easily there. The present invention allows customers to view the product, and immediately and directly access the available boxed ceiling fans without the assistance of retail store personnel.

SUMMARY OF THE INVENTION

The present invention is a modular ceiling fan display. The display comprises a display stand having a vertical support with a horizontal support base extending from the bottom of the vertical support, and a horizontal support arm extending from the top of the vertical support. A displayed ceiling fan is disposed at the distal end of the horizontal support arm. The horizontal support base is comprised of structural members that extend outward from the vertical support to form a "T" shaped outline. Boxes of displayed ceiling fans may be stacked on the horizontal support base as a part of the sales display.

BRIEF DESCRIPTION OF THE DRAWINGS

FIG. 2 is an exploded view of a connection between two support base members of the display stand.

DETAILED DESCRIPTION OF PREFERRED EMBODIMENTS

As best shown in FIGS. 1-4, the preferred embodiment of the display stand 1 comprises a segmented vertical support pole 2 connected at its top to a horizontally extending arm 4, and at the bottom to a support base 6.

Figure 1:
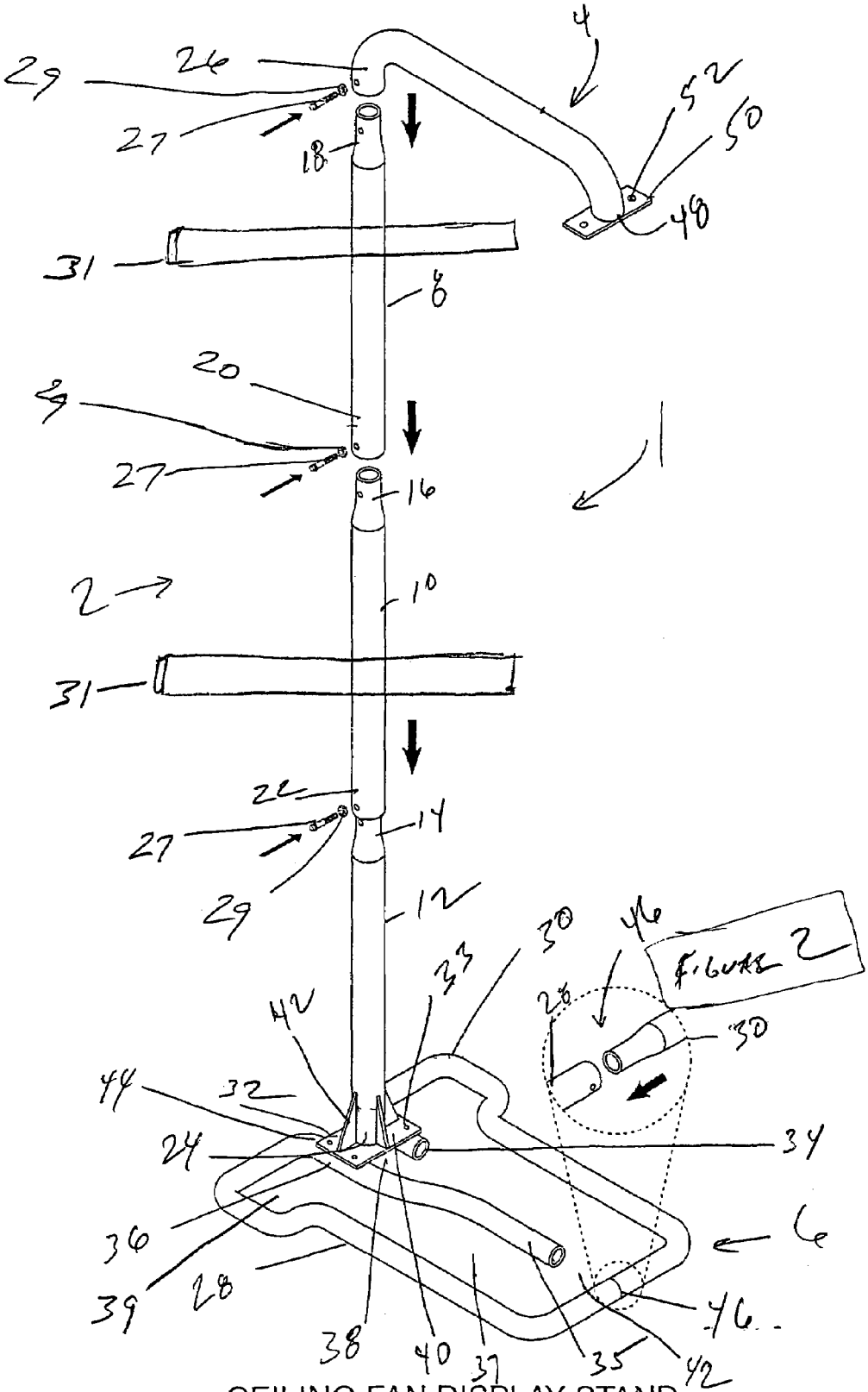
FIG. 1 is an exploded assembly drawing of the display stand.

As best shown in FIG. 1, the vertical support pole 2 is comprised of three tubular segments 8, 10, 12. The two lower segments 10, 12, are connected by sliding uppermost ends 14, 16, of the segment 10, 12, respectively, into base ends 20, 22, of the segments 8, 10 respectively. The uppermost end 18 of the top segment 8 slides into a base end 26 of the arm 4. Each of the ends 14, 16, 18, has a frustoconical shape in order to facilitate a slip-fit connection for easy assembly and disassembly.

The bottom end 24 of the bottom segment 12 is connected to the support base 6. The connections between the respective segments 8, 10, 12, are secured by threaded bolts 27 that extend perpendicularly through the segment base ends 20, 22, and arm base 26, and through the uppermost ends 14, 16, 18. Each bolt 27 is secured on the opposite side of each segment by a nut 29. Sign supports 31 may be connected by bolts, screws, or the like to vertical support pole 2 for advertising purposes.

Although three segments 8, 10, 12 are illustrated in FIG. 1, those skilled in the art will recognize that the vertical support pole 2 may be comprised of any number of segments. Moreover, the segments 8, 10, 12, and arm 4, may be joined in any manner known in the art consistent with the function of the vertical support 2. While segments 8, 10, 12, are illustrated as being tubular with frustoconical ends 14, 16, 18, other shapes may be utilized.

Figure 4:
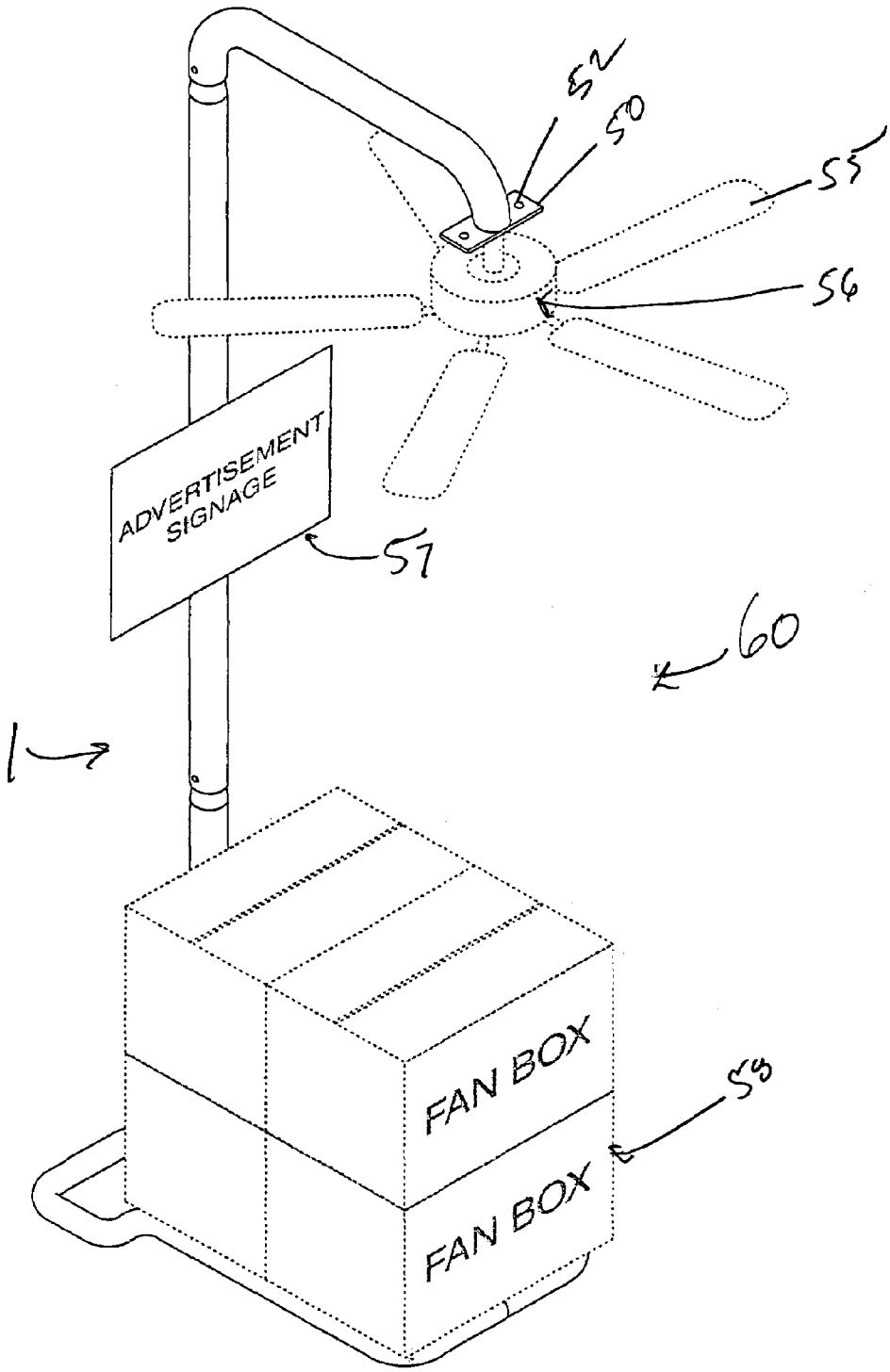
FIG. 4 is a perspective view of the sales display, including a display stand, an electrical ceiling fan, a promotional sign, and boxes of the displayed ceiling fan available for purchase.

As best shown in FIG. 1, the support base 6 is comprised of first and second tubular members 28, 30 connected to a planar base plate 32. The support members 28, 30, 32 are configured to provide the stand 1 with lateral and longitudinal stability. In the preferred embodiment, the support base 6 structural members 28, 30, 32 form an outline of a "T" shape, with each of the tubular members 28, 30 preferably having five 90° bends. The first member 28 has an end portion 35 that extends into the interior of the "T" outline, thereby forming a channel structure 37. The extension of the end portion 35 into the "T" outline further stabilizes the stand 1 and supports any product 58 (as best shown in FIG. 4) placed on the horizontal base 6, while minimizing the weight of the display apparatus. A portion 44 of the tubular members 28, 30 also extends away from the vertical support 2 in the opposite direction from the arm 4 to ensure the stability of the stand in a rearward direction.

While it is preferable that the base has a T shape, the structural members 28, 30, 32 may form any pattern consistent with the function of the invention, including a rectangular, triangular, round, or non-symmetric pattern. I prefer that the base 6 provide adequate vertical stability, minimal weight, and maximum area for locating boxes of the product.

As best shown in FIG. 2, the frustoconical portion of the most forward end (the crossbar portion of the T-shaped base defines the rear of the stand 1) of the first base member 28 slips inside the most forward end of the second base member 30 to form a secure single joint 46. As best shown in FIG. 1, at the rear of the stand 1, the base plate 32 is connected by bolts, screws, or the like 33 to the topside of the tubular members 28, 30 adjacent to the end 34 of the second member 30, and at an intermediate point 36 of the first member 28. The base plate 32 has a rectangular shape that bridges gap 38 between the tubular members 28, 30. The bottom end 24 of the bottom section 12 of the vertical support 2 is connected to the base plate 32 and extends perpendicular to the top side 40 of the base plate 32. Three triangularly shaped upwardly extending braces 42 further reinforce the bottom section 12 of the vertical support 2.

As best shown in FIG. 1, the top of the stand 1 has a horizontally extending arm 4. The arm 4 has a base end 26 and a distal end 48. In the preferred embodiment, the arm 4 has a rectangular universal mounting bracket 50 at distal end 48. The planar mounting bracket 50 is oriented horizontally, and has a pair of apertures 52 for mounting a ceiling fan 56 (See FIG. 4).

Figure 3:
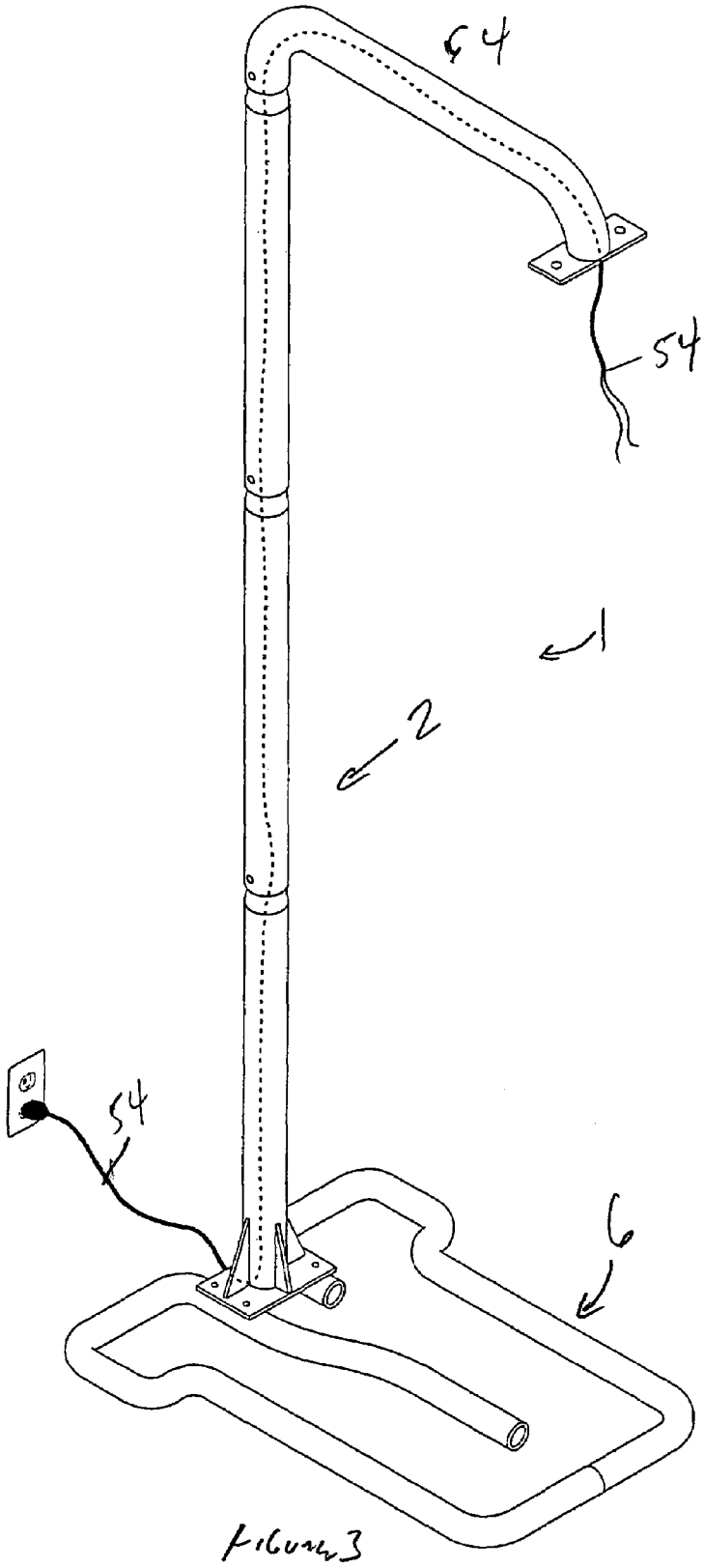
FIG. 3 is a perspective view of the display stand in the assembled condition with portions shown in phantom.

As best shown in FIG. 3, the display stand 1 may be equipped with an electrical cord 54. The cord 54 may be used to provide power to the display sign or other components associated with the display stand. I prefer that the cord 54 not be used to operate the displayed fan. Indeed, preferably the distance between the pole 2 and the fan 56 is such that the pole 2 may contact the fan blades 55 and prevent the fan blades 55 from rotating, as best shown in FIG. 4.

While the configuration shown in FIG. 1 is preferred, the base plate 32 may include any number of braces 42 shaped as required to provide stability and rigidity to the vertical support 2. Similarly, the mounting bracket 52 may be of any type known in the art consistent with the displayed product.

In operation, the display stand 1 is designed to be quickly and easily assembled and disassembled with basic hand tools. The relatively simple, lightweight, and efficient components of the display stand 1 enable a manufacturer to ship the display 1 in "knock down" form in a single package to a retailer for assembly and subsequent product promotion. The light weight enhances the mobility of the stand 1, increasing flexibility in positioning the overall display 60. As illustrated in FIG. 4, the display 60 includes the stand 1, a displayed product 56, promotional material 57, and boxes of the sales product 58. The display 60 allows a customer to view the displayed ceiling fan 56 and readily access boxes of ceiling fans 58 that the retailer has available for sale. The design of the support base 6 allows the ceiling fan boxes 58 to be elevated off the floor and avoids damage to the packaging and fans if the floor becomes wet or is dirty. The weight of the ceiling fan boxes 58 on the extended support base 6 increases the overall stability of the stand 1 by lowering the stand 1 center of gravity.

For the foregoing reasons, it is clear that the invention provides an innovative product display system. The invention may be modified in multiple ways and applied in various technological applications. The current invention may be modified and customized as required by a specific operation or application, and the individual components may be modified and defined, as required, to achieve the desired result. For example, although the structural members have been generally described as "tubular", they may also have a solid (not hollow) cross section. In addition to the circular cross section disclosed in the drawings, the structural components may have any cross sectional shape consistent with the function of the invention, including, but not limited to rectangular, triangular, or non-symmetric shapes. Similarly, although the materials of construction are not described, they may include a variety of compositions consistent with the function of the invention. Such variations are not to be regarded as a departure from the spirit and scope of the invention, and all such modifications as would be obvious to one skilled in the art are intended to be included within the scope of the following claims.

What is claimed is:

1. A product display stand, comprising:

a vertical support having a first end and a second end, an arm connected to said first end and extending outwardly therefrom, a product being displayed connected to and suspended from a distal end of said arm, wherein said product is a ceiling fan, said distal end radially spaced from a central axis of said vertical support;

a base plate connected to said second end of said vertical support, and;

support braces extending upwardly perpendicular to said base plate and adjacent to said vertical support, said base plate having a planar rectangular shape;

a horizontal base comprising at least one tubular member defining a periphery thereof and forming a T-shaped outline, said base plate secured to a first portion of said horizontal base proximate the periphery thereof, said horizontal base having a second portion extending outwardly from said vertical support and configured for receiving a plurality of ceiling fan boxes; and sign support elements extending perpendicular to said vertical support, said vertical support being tubular.

2. The stand described in claim 1, wherein said vertical support is comprised of first, second, and third segments, a top of said first segment connecting with a base of said second segment, a top of said second segment connecting to a base of said third segment, and a top of said third segment connecting to said arm.

3. The stand as described in claim 2 wherein each of said first, second, and third segments has a frustoconical end, each said frustoconical end is secured to an adjacent segment by a threaded bolt extending perpendicularly through both said segments.

4. The stand described in claim 1, wherein said arm has a U-shape and said distal end is oriented in a downwardly direction, said distal end connected to a planar horizontal mounting bracket, said ceiling fan being connected to said mounting bracket.

5. The display stand described in claim 1 wherein said horizontal base second portion comprises a planar horizontal display surface.

6. The display stand described in claim 1 wherein said arm extends above and parallel to said horizontal base.

7. The display stand of claim 1, wherein said horizontal base comprises:

a first tubular member having parallel legs;

a second tubular member disposed opposite said first tubular member, said second tubular member having parallel legs extending parallel to and spaced from said first tubular member parallel legs, wherein said first tubular member is connected to said second tubular member to form the T-shaped outline, and said base plate is secured to adjacent ones of said first and second tubular member parallel legs proximate the periphery of said horizontal base.

8. The stand as described in claim 7, wherein, each of said first tubular member and said second tubular member has a first end and a second end, a frustoconical portion of said second tubular member first end slides inside said first tubular member first end to form a single joint, said base plate is connected to said first tubular member at an intermediate point thereof, said base plate is connected to said second tubular member adjacent to said second end thereof.

9. The stand as described in claim 8, wherein said joint is positioned on a vertical plane that passes through each of said base plate, said vertical support, said arm, and said product, said vertical plane also passing through said horizontal base first tubular member second end.

10. The stand as described in claim 8, wherein said first tubular member is longer than said second tubular member, said first tubular member extending into an interior of said T-shaped outline to form a channel, said channel having an opening perpendicular to said channel longitudinal axis.

11. The stand as described in claim 8, wherein said horizontal base is configured so that said first tubular member second end and said second tubular member second end extend perpendicular to said first tubular member first end and said second tubular member first end.

12. The stand as described in claim 11 wherein each of said first and said second tubular members are configured to have five 90° bends.

13. The stand as described in claim 12, wherein said first tubular member second end extends into an interior of said T-shaped outline further than said second tubular member second end.

* * * * *